US010028525B2

(12) United States Patent
Kraker

(10) Patent No.: US 10,028,525 B2
(45) **Date of Patent: *Jul. 24, 2018**

(54) SMOKING ARTICLES WITH REDUCED IGNITION PROCLIVITY CHARACTERISTICS

(71) Applicant: Schweitzer-Mauduit International, Inc., Alpharetta, GA (US)

(72) Inventor: Thomas A. Kraker, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 867 days.

This patent is subject to a terminal disclaimer.

(21) Appl. No.: 14/502,111

(22) Filed: Sep. 30, 2014

(65) Prior Publication Data

US 2015/0013707 A1 Jan. 15, 2015

Related U.S. Application Data

(60) Continuation of application No. 10/891,375, filed on Jul. 14, 2004, now Pat. No. 8,863,757, which is a (Continued)

(51) Int. Cl.
*A24D 1/00* (2006.01)
*D21H 11/00* (2006.01)
(Continued)

(52) U.S. Cl.
CPC ..... *A24D 1/025* (2013.01); *A24C 5/005* (2013.01); *Y10T 428/258* (2015.01); *Y10T 428/31971* (2015.04); *Y10T 428/31975* (2015.04)

(58) Field of Classification Search
None
See application file for complete search history.

(56) References Cited

U.S. PATENT DOCUMENTS 218,389 A 2/1879 Lucas
225,858 A 3/1880 O'Connor
(Continued)

FOREIGN PATENT DOCUMENTS

AT 146513 7/1936
AT 175148 6/1953
(Continued)

OTHER PUBLICATIONS http://legacy.library.ucsf.edu/tid/csk36a00.*
(Continued)

*Primary Examiner* — Michael J Felton
*Assistant Examiner* — Phu Nguyen
(74) *Attorney, Agent, or Firm* — Dority & Manning, P.A.

(57) ABSTRACT

A process for reducing the permeability of a paper wrapper used in the construction of a smoking article is disclosed. The paper wrapper is treated with a film-forming composition that forms treated discrete areas on the wrapper. The treated discrete areas have a permeability within a predetermined range sufficient to reduce the ignition proclivity properties of a smoking article made with the wrapper. In accordance with the present invention, the film-forming composition contains a film-forming material. The film-forming material has a relatively low viscosity. In this manner, the film-forming composition can have a relatively high solids content and still be applied to the wrapper using conventional techniques, such as by using a gravure printer.

13 Claims, 2 Drawing Sheets

Related U.S. Application Data division of application No. 10/055,027, filed on Jan. 23, 2002, now Pat. No. 6,779,530.

(51) Int. Cl.
*A24D 1/02* (2006.01)
*A24C 5/00* (2006.01)

(56) References Cited

U.S. PATENT DOCUMENTS 625,293 A 5/1899 Doutney
671,548 A 4/1901 Gordon
1,862,679 A 6/1921 Holsman
1,555,320 A 4/1923 Weil
1,581,451 A 4/1926 Knapp
1,605,059 A 11/1926 Oakes et al.
1,666,062 A 4/1928 Alexander
1,726,737 A 9/1929 Harris
1,744,615 A 1/1930 Crosthwait
1,770,616 A 7/1930 Kean
1,798,537 A 3/1931 Honigbaum
1,863,000 A 6/1932 Barnes
1,879,128 A 9/1932 Desper
1,905,416 A 4/1933 Low
1,996,002 A 3/1935 Seaman
1,999,222 A 4/1935 Weinberger
1,999,223 A 4/1935 Weinberger
1,999,224 A 4/1935 Miles
2,013,508 A 9/1935 Seaman
2,028,552 A 2/1936 Low
2,049,320 A 7/1936 Ruben et al.
2,098,619 A 11/1937 Finnell
2,147,889 A 2/1939 Gardiner et al.
2,185,293 A 1/1940 Copeman
2,246,929 A 6/1941 Seney
2,307,088 A 1/1943 Whiteley
2,327,991 A 8/1943 Betts
2,329,927 A 9/1943 Morton
2,335,432 A 11/1943 Millett
2,547,119 A 4/1951 Henderson
2,666,437 A 1/1954 Lattof
2,673,799 A 3/1954 Schur et al.
2,682,270 A 6/1954 Schur
2,718,889 A 9/1955 Claussen
2,746,890 A 5/1956 Legler
2,754,828 A 7/1956 Swain
2,775,970 A 1/1957 Schoenbaum
2,776,912 A 1/1957 Gregory
2,890,704 A 6/1959 Lamm
2,976,190 A 3/1961 Meyer
2,985,175 A 5/1961 Rich
2,992,647 A 7/1961 Figge
2,998,012 A 8/1961 Lamm
3,030,963 A 4/1962 Cohn
3,081,776 A 3/1963 Park
3,091,243 A 5/1963 Guida
3,102,543 A 9/1963 O'Siel et al.
3,165,105 A 1/1965 Campbell
3,215,579 A 11/1965 Hagen
3,220,418 A 11/1965 Cohn
3,228,402 A 1/1966 Lebert
3,276,453 A 10/1966 Corley
3,285,253 A 11/1966 Lebert
3,288,145 A 11/1966 Rosenthal
3,349,776 A 10/1967 Bell et al.
3,370,593 A 2/1968 Owaki
3,409,021 A 11/1968 Owaki
3,511,247 A 5/1970 Tamol
3,526,904 A 9/1970 Tamol
3,528,432 A 9/1970 Stossel
3,599,153 A 8/1971 Lewis et al.
3,620,801 A 11/1971 O'Grady
3,632,384 A 1/1972 Saint-Pastou
3,633,589 A 1/1972 Kahane
3,667,479 A 6/1972 Sanford et al.
3,699,973 A 10/1972 Tamol et al.
3,702,117 A 11/1972 Borthwick
3,736,940 A 6/1973 Saint-Pastou
3,805,799 A 4/1974 Stewart et al.
3,874,390 A 4/1975 Eicher et al.
3,903,899 A 9/1975 Musillo
3,911,932 A 10/1975 Houck, Jr. et al.
3,949,762 A 4/1976 West et al.
3,977,416 A 8/1976 Akiba
3,985,143 A 10/1976 Lappin, Jr.
4,044,778 A 8/1977 Cohn
4,061,147 A 12/1977 Falchi
4,077,414 A 3/1978 Baker et al.
4,091,821 A 5/1978 Scorzo
4,121,597 A 10/1978 Shin
4,129,134 A 12/1978 Hind et al.
4,140,760 A 2/1979 Withington
4,143,404 A 3/1979 Williams, Jr. et al.
4,146,040 A 3/1979 Cohn
4,187,862 A 2/1980 Cohn
4,222,740 A 9/1980 Bohrn et al.
4,226,249 A 10/1980 Newman
4,230,131 A 10/1980 Simon
4,231,377 A 11/1980 Cline et al.
4,236,532 A 12/1980 Schweizer et al.
4,239,591 A 12/1980 Blake
4,243,053 A 1/1981 Cartwright et al.
4,267,240 A 5/1981 Jaisle et al.
4,303,084 A 12/1981 Simon
4,351,638 A 9/1982 Finlayson, III et al.
4,386,108 A 5/1983 Richter
4,407,308 A 10/1983 Baker et al.
4,420,002 A 12/1983 Cline
4,436,101 A 3/1984 Seatts
4,450,847 A 5/1984 Owens
4,452,259 A 6/1984 Norman et al.
4,453,553 A 6/1984 Cohn
4,461,311 A 7/1984 Mathews et al.
4,480,650 A 11/1984 Weinert
4,489,738 A 12/1984 Simon
4,489,739 A 12/1984 Mattina, Jr. et al.
4,543,370 A 9/1985 Porter et al.
4,590,955 A 5/1986 Dixit
4,607,647 A 8/1986 Dashley et al.
4,615,345 A 10/1986 Durocher
4,619,278 A 10/1986 Smeed et al.
4,622,983 A 11/1986 Mathews et al.
4,624,268 A 11/1986 Baker et al.
4,643,205 A 2/1987 Redding et al.
4,665,648 A 5/1987 Kahn
4,679,575 A 7/1987 Yamaguchi et al.
4,715,345 A 12/1987 Reames, Jr.
4,739,775 A 4/1988 Hampl, Jr.
4,765,348 A 8/1988 Honeycutt
4,779,631 A 10/1988 Durocher et al.
4,784,164 A 11/1988 Adams et al.
4,805,644 A 2/1989 Hampl, Jr. et al.
4,880,870 A 11/1989 Zimmermann et al.
4,889,145 A 12/1989 Adams et al.
4,909,854 A 3/1990 Light et al.
4,928,715 A 5/1990 Mentzel et al.
4,945,932 A 8/1990 Mentzel et al.
4,984,589 A 1/1991 Riedesser
4,998,542 A 3/1991 Kallianos et al.
5,057,158 A 10/1991 Rohr et al.
5,057,606 A 10/1991 Garbe
5,060,674 A 10/1991 Brown et al.
5,060,675 A 10/1991 Milford et al.
5,092,353 A 3/1992 Montoya
5,103,844 A 4/1992 Hayden et al.
5,106,417 A 4/1992 Hauser et al.
5,120,368 A 6/1992 Houminer et al.
5,129,954 A 7/1992 Chan et al.
5,131,416 A 7/1992 Gentry
5,143,099 A 9/1992 Le Gars et al.
5,144,966 A 9/1992 Washington
5,161,550 A 11/1992 Owens, Jr.
5,170,807 A 12/1992 Kasbo et al.
5,178,167 A 1/1993 Riggs et al.

(56) References Cited

U.S. PATENT DOCUMENTS

| | | | | |
|---|---|---|---|---|
| 5,191,906 | A | 3/1993 | Myracle, Jr. | |
| 5,200,020 | A | 4/1993 | Collins et al. | |
| 5,221,502 | A | 6/1993 | Washington | |
| 5,231,524 | A | 7/1993 | De Keyzer et al. | |
| 5,259,404 | A | 11/1993 | Case et al. | |
| 5,261,425 | A | 11/1993 | Raker et al. | |
| 5,263,999 | A | 11/1993 | Baldwin et al. | |
| 5,271,419 | A | 12/1993 | Arzonico et al. | |
| 5,316,575 | A | 5/1994 | Lent et al. | |
| 5,332,472 | A | 7/1994 | Cutright et al. | |
| 5,342,484 | A | 8/1994 | Cutright et al. | |
| 5,360,516 | A | 11/1994 | Cutright et al. | |
| 5,393,333 | A | 2/1995 | Trouve | |
| 5,417,228 | A | 5/1995 | Baldwin et al. | |
| 5,450,862 | A | 9/1995 | Baldwin et al. | |
| 5,450,863 | A | 9/1995 | Collins et al. | |
| 5,474,095 | A | 12/1995 | Allen et al. | |
| 5,478,627 | A | 12/1995 | Hara et al. | |
| 5,503,876 | A | 4/1996 | Fields et al. | |
| 5,523,014 | A * | 6/1996 | Dolan | C11D 3/18 510/139 |
| 5,534,114 | A | 7/1996 | Cutright et al. | |
| 5,540,242 | A | 7/1996 | Chao et al. | |
| 5,690,787 | A | 11/1997 | Hultman et al. | |
| 5,722,433 | A | 3/1998 | Ishino et al. | |
| 5,730,840 | A | 3/1998 | Hampl, Jr. et al. | |
| 5,820,998 | A * | 10/1998 | Hotaling | A24D 1/025 131/365 |
| 5,849,153 | A | 12/1998 | Ishino et al. | |
| 5,878,753 | A * | 3/1999 | Peterson | A24D 1/025 131/336 |
| 5,878,754 | A | 3/1999 | Peterson et al. | |
| 5,888,348 | A | 3/1999 | Hampl, Jr. | |
| 5,893,372 | A | 4/1999 | Hampl, Jr. | |
| 5,921,249 | A | 7/1999 | Hampl, Jr. | |
| 5,966,218 | A | 10/1999 | Bokelman et al. | |
| 5,997,691 | A | 12/1999 | Gautam et al. | |
| 6,020,969 | A | 2/2000 | Struckhoff et al. | |
| 6,129,087 | A | 10/2000 | Wallace et al. | |
| 6,198,537 | B1 | 3/2001 | Bokelman et al. | |
| 6,298,860 | B1 | 10/2001 | Hampl et al. | |
| 6,314,964 | B1 * | 11/2001 | Hampl, Jr. | A24D 1/02 131/331 |
| 6,371,127 | B1 | 4/2002 | Snaidr et al. | |
| 6,568,403 | B2 | 5/2003 | Hampl, Jr. et al. | |
| 6,606,999 | B2 | 8/2003 | Crooks et al. | |
| 6,645,605 | B2 | 11/2003 | Hammersmith et al. | |
| 6,705,325 | B1 | 3/2004 | Hicks et al. | |
| 6,722,373 | B2 | 4/2004 | Bowen et al. | |
| 6,725,867 | B2 | 4/2004 | Peterson et al. | |
| 6,748,955 | B2 | 6/2004 | Snaidr et al. | |
| 6,779,530 | B2 | 8/2004 | Kraker | |
| 6,854,469 | B1 | 2/2005 | Hancock et al. | |
| 6,860,274 | B2 | 3/2005 | Matsufuji et al. | |
| 6,929,013 | B2 | 8/2005 | Ashcraft et al. | |
| 6,976,493 | B2 | 12/2005 | Chapman et al. | |
| 7,234,471 | B2 | 6/2007 | Fitzgerald et al. | |
| 2002/0129824 | A1 | 9/2002 | Hammersmith et al. | |
| 2002/0179105 | A1 | 12/2002 | Zawadzki et al. | |
| 2002/0179106 | A1 | 12/2002 | Zawadzki et al. | |
| 2003/0131860 | A1 | 7/2003 | Ashcraft | |
| 2003/0145869 | A1 | 8/2003 | Kitao et al. | |
| 2003/0150466 | A1 | 8/2003 | Kitao et al. | |
| 2003/0164173 | A1 | 9/2003 | Zawadzki et al. | |
| 2004/0007242 | A1 | 1/2004 | Finlay et al. | |
| 2004/0011368 | A1 | 1/2004 | Tsutsumi et al. | |
| 2004/0011369 | A1 | 1/2004 | Matsufuji et al. | |
| 2004/0020502 | A1 | 2/2004 | Tosas Fuentes et al. | |
| 2004/0094171 | A1 | 5/2004 | Wanna et al. | |
| 2004/0123874 | A1 | 7/2004 | Zawadzki et al. | |
| 2004/0129283 | A1 | 7/2004 | Trummer et al. | |
| 2004/0182407 | A1 | 9/2004 | Peterson et al. | |

FOREIGN PATENT DOCUMENTS

| | | |
|---|---|---|
| BE | 537531 | 5/1955 |
| BE | 659839 | 6/1965 |
| CA | 175005 | 2/1917 |
| CA | 496123 | 9/1953 |
| CA | 694631 | 9/1964 |
| CA | 835684 | 3/1970 |
| CA | 2319855 | 3/2000 |
| CH | 142429 | 11/1930 |
| CH | 240987 | 6/1946 |
| CH | 484468 | 1/1970 |
| CH | 622411 | 4/1981 |
| DE | 146513 | 12/1903 |
| DE | 613294 | 5/1925 |
| DE | 549936 | 5/1932 |
| DE | 608407 | 1/1935 |
| DE | 1959684 | 6/1971 |
| DE | 2206185 | 8/1972 |
| DE | 2120586 | 11/1972 |
| DE | 2162168 | 7/1973 |
| DE | 2308658 | 8/1974 |
| DE | 2308667 | 9/1974 |
| DE | 2444929 | 4/1975 |
| DE | 2537334 | 3/1976 |
| DE | 2559071 | 7/1976 |
| DE | 2906417 | 8/1980 |
| DE | 3741008 | 6/1988 |
| DE | 4202750 | 8/1993 |
| EP | 0 231 664 | 8/1987 |
| EP | 0281967 | 9/1988 |
| EP | 0193607 | 1/1989 |
| EP | 0386884 | 9/1990 |
| EP | 0419975 | 4/1991 |
| EP | 0426459 | 8/1991 |
| EP | 0483998 | 5/1992 |
| EP | 0486213 | 5/1992 |
| EP | 0559300 | 9/1993 |
| EP | 0601933 | 6/1994 |
| EP | 0 671 505 | 9/1995 |
| EP | 0842615 | 5/1998 |
| EP | 0864259 | 9/1998 |
| EP | 0870437 | 10/1998 |
| EP | 0892110 | 1/1999 |
| EP | 1 084 629 | 3/2001 |
| EP | 1166656 | 1/2002 |
| EP | 1482815 | 7/2003 |
| EP | 1 417 899 | 5/2004 |
| EP | 2127543 | 12/2009 |
| EP | 2127544 | 12/2009 |
| EP | 2127545 | 12/2009 |
| EP | 1333729 | 12/2010 |
| FR | 1040981 | 5/1953 |
| FR | 1517262 | 2/1968 |
| FR | 1560360 | 2/1969 |
| FR | 2 548 675 | 1/1985 |
| FR | 2556184 | 6/1985 |
| FR | 2 470 598 | 6/1991 |
| GB | 14494 | 0/1884 |
| GB | 264045 | 1/1929 |
| GB | 528190 | 10/1940 |
| GB | 646020 | 11/1950 |
| GB | 672298 | 5/1952 |
| GB | 760772 | 11/1956 |
| GB | 835923 | 5/1960 |
| GB | 848332 | 9/1960 |
| GB | 933161 | 8/1963 |
| GB | 1093536 | 2/1965 |
| GB | 1056941 | 2/1967 |
| GB | 1214319 | 12/1970 |
| GB | 1436073 | 5/1976 |
| GB | 1524211 | 9/1978 |
| GB | 2020535 | 11/1979 |
| GB | 2025753 | 1/1980 |
| GB | 2100572 | 1/1983 |
| GB | 2145919 | 4/1985 |
| IT | 317118 | 4/1934 |
| JP | 54052686 | 4/1979 |
| JP | 5195197 | 8/1993 |

(56) References Cited

FOREIGN PATENT DOCUMENTS

| | | |
|---|---|---|
| WO | WO 81/02243 | 8/1981 |
| WO | WO 86/01377 | 3/1986 |
| WO | WO 86/06591 | 11/1986 |
| WO | WO 88/01478 | 3/1988 |
| WO | WO 91/14729 | 10/1991 |
| WO | WO 9816125 | 4/1998 |
| WO | WO 9953778 | 10/1999 |
| WO | WO 0011976 | 3/2000 |
| WO | WO 02/37991 | 5/2002 |
| WO | WO 0243513 | 6/2002 |
| WO | WO 02/067704 | 9/2002 |
| WO | WO 02/078471 | 10/2002 |
| WO | WO 03034845 | 5/2003 |
| WO | WO 03/061410 | 7/2003 |
| WO | WO 03064165 | 8/2003 |
| WO | WO 03088771 | 10/2003 |

OTHER PUBLICATIONS

Article—Pulp and Paper Chemistry and Chemical Technology, James P. Casey, Canada, 1981, pp. 1517-1521 and 1702-1703.
Kimberly-Clark, Product List of Cigarette Papers, 5 pages (Nov. 13, 1993).
Ecusta, Standard Products Catalog of Cigarette Papers, 3 pages (Apr. 15, 1987).
Expert Report of S. Wayne McCarty, US International Trade Commission Investigation No. 337-TA-756, dated Jul. 7, 2011, 476 pages.
Expert Report of Rufus H. Honeycutt III, US International Trade Commission Investigation No. 337-TA-756, dated Jul. 28, 2011, 544 pages.
Expert Report of Charles P. Klass and Exhibits 1-40, US International Trade Commission Investigation No. 337-TA-756, dated Jul. 7, 2011, 694 pages.
Expert Report of Samuel Schabel, US International Trade Commission Investigation No. 337-TA-756, dated Jul. 6, 2011, 14 pages.
Expert Report of Arthur M. Ihrig, US International Trade Commission Investigation No. 337-TA-756, dated Jul. 7, 2011, 274 pages.
Expert Report of J. Gregory Sidak, US International Trade Commission Investigation No. 337-TA-756, dated Jul. 7, 2011, 591 pages.
Julius Glatz's and LIPtec's Supplemental Responses to Schweitzer-Mauduit International's Interrogatories 48, 50, 51, 57, 59 and 60, US International Trade Commission Investigation No. 337-TA-756, dated Jun. 6, 2011, 51 pages.
Julius Glatz's and LIPtec's Supplemental Responses to Schweitzer-Mauduit International's Interrogatories 49, 52, 55 and 58, US International Trade Commission Investigation No. 337-TA-756, dated Jun. 13, 2011, 20 pages.
Julius Glatz's and LIPtec's Responses and Objections to Schweitzer-Mauduit International's Second Set of Interrogatories (Nos. 79-82), US International Trade Commission Investigation No. 337-TA-756, dated Jun. 6, 2011, 19 pages.
Julius Glatz's and LIPtec's Responses to Schweitzer-Mauduit International's First Set of Interrogatories (Nos. 1-78), US International Commission Investigation No. 337-TA-756, dated Feb. 7, 2011, 113 pages.
First Amended Response of Respondent DelfortGroup AG to Complainant Schweitzer-Mauduit International, Inc.'s Interrogatory Nos. 10, 29-30, 48-51, 57 and 60 and Second Amended Response of Respondent Delfortgroup AG to Complainant Schweitzer-Mauduit International, Inc.'s Interrogatory No. 3, US International Trade Commission Investigation No. 337-TA-756, dated Jun. 6, 2011, 37 pages.
Response of Respondent DelfortGroup AG to Complainant Schweitzer-Mauduit International, Inc.'s Third Set of Interrogatories to Respondent Delfortgroup AG (Nos. 87-90), US International Trade Commission Investigation No. 337-TA-756, dated Jun. 6, 2011, 16 pages.
Response of Respondent DelfortGroup AG to Complainant Schweitzer-Mauduit International, Inc.'s First Set of Interrogatories, US International Trade Commission Investigation No. 337-TA-756, dated Feb. 7, 2011, 77 pages.
First Amended Response of Respondent Astra Tobacco Corp. to Complainant Schweitzer-Mauduit International, Inc.'s Interrogatory Nos. 38 and 44 and Second Amended Response of Respondent Astra Tobacco Corp. to Complainant Schweitzer-Mauduit International, Inc.'s Interrogatory Nos. 34,43, US International Trade Commission investigation No. 337-TA-756, dated Jun. 13, 2011, 20 pages.
First Amended Response of Respondent Astra Tobacco Corp. to Complainant Schweitzer-Mauduit International, Inc.'s First Set of Interrogatories (Nos. 34-37, 43 and 46), US International Trade Commission Investigation No. 337-TA-756, dated Jun. 6, 2011, 26 pages.
Response of Respondent Astra Tobacco Corp. to Complainant Schweitzer-Mauduit International, Inc.'s First Set of Interrogatories, US International Trade Commission Investigation No. 337-TA-756, dated Feb. 7, 2011, 54 pages.
Respondent Delfortgroup AG, Dr. Franz Feurstein GmbH, Papierfabrik Wattens GmbH & Co. KG, Astra Tobacco Corp., Dosal Tobacco Corp., Farmer's Tobacco Co., S&M Brands, Inc., and Tantus Tobacco LLC's Motion for Summary Determination of Invalidity of Claims 36, 43 and 45 of the '867 Patent, US International Trade Commission Investigation No. 337-TA-756, dated Jun. 2, 2011, 37 pages.
Opposition of EP 1 333 729 B1 filed by Delfortgroup AG with the European Patent Office on Sep. 8, 2011, 360 pages (filed in German; no English translation available).
Further Sumbission in Opposition of EP 1 333 729 B1 filed by Julius Glatz GmbH with the European Patent Office on Sep. 6, 2011, 96 pages (filed in German; no English translation available).
Opposition of EP 1 333 729 B1 filed by Miguel y Costas Miguel S.A. with the European Patent Office on Sep. 8, 2011, 183 pages.
Opposition of EP 1 333 729 B1 filed by Papeteries du Leman SAS with the European Patent Office on Sep. 8, 2011, 396 pages (filed in French; no English translation available).
Initial Determination on Violation of Section 337 and Recommended Determination on Remedy and Bond, US International Trade Commission, Investigation No. 337-TA-756, issued Feb. 1, 2012.
Complainant Schweitzer-Mauduit International, Inc.'s Petition for Review of the Initial Determination, US International Trade Commission, Investigation No. 337-TA-756, filed Feb. 14, 2012.
Summary of Complainant Schweitzer-Maudnit International, Inc.'s Petition for Review of the Initial Determination, US International Trade Commission, Investigation No. 337, TA-756, dated Feb. 14, 2012.
Glatz Respondents'Contingent Petition for Review of the Intitial Determination, US International Trade Commission, Investigation No. 337-TA-756, filed Feb. 14, 2012.
Summary of Glatz Respondents' Contingent Petition for Review of the Initial Determination, US International Trade Commission, Investigation No. 337-TA-756, dated Feb. 14, 2012.
Patent Owner Response to Third Party Comments, U.S. Patent & Trademark Office ReExamination 95/001,493, in Re U.S. Pat. No. 6,725,867, filed Jul. 29, 2011.
Third Party Comments, U.S. Patent & Trademark Office ReExamination 95/001,493, in Re U.S. Pat. No. 6,725,867, filed Aug. 26, 2011.
Third Party Comments, U.S. Patent & Trademark Office ReExamination 95/001,493, in Re U.S. Pat. No. 6,725,867, filed Jun. 16, 2011.
Supplemental Inventor Affidavit, U.S, Patent & Trademark Office ReExamination 95/001,493, in Re U.S. Pat. No. 6,725,867, filed May 18, 2011.
Patent Owner Response and Inventor Affidavits, U.S. Patent & Trademark Office ReExamination 95/001,493, in Re U.S. Pat. No. 6,725,867, filed May 17, 2011.
Office Action, U.S. Patent & Trademark Office ReExamination 95/001,493, in Re U.S. Pat. No. 6,725,867, dated Mar. 17, 2011.

(56) References Cited

OTHER PUBLICATIONS

ReExamination Order, U.S. Patent & Trademark Office ReExamination 95/001,493, in Re U.S. Pat. No. 6,725,867, dated Feb. 23, 2011.
Third Party ReExamination Request, U.S. Patent & Trademark Office ReExamination 95/001,493, in Re U.S. Pat. No. 6,725,867, filed Nov. 24, 2010.
Glatz Respondents' Post-Hearing Brief, US International Trade Commission Investigation No. 337-TA-756, dated Nov. 18, 2011, 193 pages (CBI redacted).
Glatz Respondents' Proposed High-Priority Findings of Fact, US International Trade Commission Investigation No. 337-TA-756, dated Nov. 18, 2011, 16 pages (CBI redacted).
Commission Investigative Staff's Proposed Findings of Fact, US International Trade Commission Investigation No. 337-TA-756, dated Nov. 18, 2011, 25 pages (CBI redacted).
Complainant Schweitzer-Mauduit International, Inc.'s Post-Hearing Brief, US International Trade Commission Investigation No. 337-TA-756, dated Nov. 18, 2011, 183 pages (CBI redacted).
Complainant Schweitzer-Mauduit International, Inc.'s Proposed High Priority Findings of Fact in Support of its Post-Hearing Brief, US International Trade Commission Investiagtion No. 337-TA-756, dated Nov. 18, 2011, 27 pages (CBI redacted).
Commission Investigative Staff's Post-Hearing Brief, US International Trade Commission Investigation No. 337-TA-756, dated Nov. 18, 2011, 104 pages (CBI redacted).
Glatz Respondents' Objections and Rebuttals to Commission Investigative Staff's Proposed High-Priority Findings of Fact, US International Trade Commission Investigation No. 337-TA-756, dated Nov. 30, 2011, 10 pages (CBI redacted).
Glatz Respondents' Objections to Schweitzer-Mauduit International, Inc.'s Proposed High-Priority Findings of Fact, US International Trade Commission Investigation No. 337-TA-756, dated Nov. 30, 2011, 64 pages (CBI redacted).
Glatz Respondents' Reply to Schweitzer-Mauduit International, Inc.'s Power-Hearing Brief, US International Trade Commission Investigation No. 337-TA-756, dated Nov. 30, 2011, 141 pages (CBI redacted).
Commission Investigative Staff's Post-Hearing Reply Brief, US International Trade Commission Investigation No. 337-TA-756, dated Nov. 30, 2011, 49 pages (CBI redacted).
Commission Investigative Staff's Response to Complainant's Proposed Findings of Fact, US International Trade Commission Investigation No. 337-TA-756, dated Nov. 30, 2011, 32 pages (CBI redacted).
Commission Investigative Staff's Response to Respondents' Proposed Findings of Fact, US International Trade Commission Investigation No. 337-TA-756, dated Nov. 30, 2011, 19 pages (CBI redacted).
Complainant Schweitzer-Mauduit International, Inc.'s Response to the Staff's Proposed High Priority Findings of Fact in Support of its Post-Hearing Brief, US International Trade Commission Investigation No. 337-TA-756, dated Nov. 30, 2011, 70 pages (CBI redacted).
Complainant Schweitzer-Mauduit International, Inc.'s Post-Hearing Reply Brief, US International Trade Commission Investigation No. 337-TA-756, dated Nov. 30, 2011, 134 pages (CBI redacted).
Complainant Schweitzer-Mauduit International, Inc.'s Response to Glatz's Proposed High Priority Findings of Fact in Support of its Post-Hearing Brief, US International Trade Commission Investigation No. 337-TA-756, dated Nov. 30, 2011, 100 pages (CBI redacted).
Supplemental Inventor Affidavit, U.S. Patent & Trademark Office ReExamination 95/001,493, in Re U.S. Pat. No. 6,725,867, filed May 18, 2011.
Publication, "Relative Ignition Propensity of Test Market Cigarettes", Richard G. Gann, et al., National Institute of Standards and Technology, Technology Administration, U.S. Department of Commerce, Jan. 2001.
Publication, "The Effect of Cigarette Characteristics on the Ignition of Soft Furnishings", Richard G. Gann, et al., Center for Fire Research National Bureau of Standards, Oct. 1987.
Publication, "Overview: Practicability of Developing a Performance Standard to Reduce Cigarette Ignition Propensity", U.S. Consumer Product Safety Commission, Aug. 1993.
Publication, "Cigarette Ignition Performance", J.T. Wanna and P.X. Chen, Journal of Fire Sciences, vol. 19, Sep./Oct. 2001, pp. 355-368.
German Standard, DIN ISO 2965, Materials used as cigarette papers, filter plug wrap and filter joining paper, including materials having an oriented permeable zone—Determination of air permeability, Jan. 2000, 19 pages.
Opposition to European Patent 1 333 729, submitted Dec. 8, 2010 (Original German), 33 pages.
Opposition to European patent 1 333 729, submitted Dec. 8, 2010 (English Translation), 23 pages.
Third Party Observations submitted by Japan Tobacco Inc., Nov. 20, 2007.
U.S. Pat. No. 6,725,867 File History, 179 pages.
U.S. Appl. No. 10/813,107 File History, 720 pages.
Brazilian Patent and Trademark Office, Application No. PI 0115333-1. Technical Report, issued Jul. 7, 2010, 2 pages.
Canadian Intellectual Property Office, Application No. 2,427,830, Requisition by Examiner, issued May 24, 2007, 2 pages.
Canadian Intellectual Property Office, Application No. 2,643,087, Requisition by Examiner, issued Nov. 8, 2010, 4 pages.
Canadian Intellectual Property Office, Application No. 2,643,087, Response to Nov. 8, 2010 Examiner's Requisition, dated Apr. 15, 2011, 7 pages.
Canadian Intellectual Property Office, Application No. 2,643,090, Requisition by Examiner, issued Nov. 2, 2010, 2 pages.
Canadian Intellectual Property Office, Application No. 2,643,090, Response to Nov. 2, 2010 Examiner's Requisition, dated Apr. 15, 2011, 7 pages.
Chinese Patent Office, Application No. 01818776.5, First Office Action, 4 pages.
Chinese Patent Office, Application No. 01818776.5, Second Office Action, 2 pages.
Chinese Patent Office, Application No. 200610059510.1, First Office Action, 6 pages.
European Patent Office, Patent No. 1 333 729 File History, 814 pages.
European Patent Office, Application No. 09168879.6 File History, 85 pages.
European Patent Office, Application No. 09168886.1 File History, 104 pages.
European Patent Office, Application No. 09168880.4 File History, 84 pages.
India Patent Office, Application No. 0649/CHENP/2003, First Examination Report, dated May 23, 2006, 3 pages.
Japanese Patent Office, Application No. 2002-540589, Notice of Rejection, dated Sep. 15, 2006, 3 pages.
Japanese Patent Office, Application No. 2002-540589, Response to Sep. 15, 2006 Notice of Rejection, dated Mar. 15, 2007, 7 pages.
Japanese Patent Office, Application No. 2002-540589, Decision to Grant Patent, dated Apr. 6, 2007, 2 pages.
Japanese Patent Office, Demand for Trial for Invalidation, filed Oct. 24, 2007, 197 pages.
Japanese Patent Office, Answer to Demand for Trial for Invalidation, filed Jan. 22, 2008, 126 pages.
Japanese Patent Office, Second Argument for Trial for Invalidation, filed Mar. 7, 2008, 14 pages.
Japanese Patent Office, Trial Decision, issued Jul. 28, 2008, 55 pages.
Mexican Patent Office, Application No. PA/a/2003/004072, Official Action, dated Sep. 1, 2005, 1 page.
PCT International Search Report, Application No. PCT/US01/51221, dated Apr. 17, 2002, 4 pages.
Julius Glatz Gmbh, Liptec GmbH, and Knex Worldwide LLC's Notice of Prior Art, US International Trade Commission Investigation No. 337-TA-756, dated May 12, 2011, 22 pages.
Delfortgroup AG, Dr. Franz Feurstein Gmbh, Papierfabrik Wattens Gmbh & Co. KG, Astra Tobacco Corp., Dosal Tobacco Corp., Famer's Tobacco Co., S&M Brands, Inc., and Tantus Tobacco

(56) References Cited

OTHER PUBLICATIONS

LLC's Notice of Prior Art, US International Trade Commission Investigation No. 337-TA-756, dated May 12, 2011, 8 pages.
Presentation—"Using Paper Diffusion Measuremetns to Assess the Ignition Strength of Cigarettes," Durocher, et al., 24 pages.
Coresta Recommended Method No. 40—Determination of Air Permeability of Materials used as Cigarette Papers, Fuilter Plub Wrap and Filter Joining Paper Including Materials Having an Oriented Permeable Zone, Oct. 1994, 18 pages.
"Factors Affecting Static Burning Rate," Resnik, et al., Tobacco Science, vol. 21, Oct. 1, 1978, pp. 103-107.
Schweitzer-Manduit "Cigarette Paper Porosity Conversion Charts," Jun. 1976, 1 page.
Abstract—"The development of banded cigarette paper to reduce fabric ignition propensity," Reynolds, et al., Mar. 2000, 1 page.
"Cigarette Design and Materials," Tobacco Production, Chemistry and Technology, edited by D. Layten Davis and Mark T. Nielsen, pp. 353-387.
R. Ginman et al., Requirements of the flexographic printing process on wrapping paper and packaging board, 19 Advances in Printing Sci. & Tech., 211, 214-215 (1987), 3 pages.
Product and Process Description, *Delfortgroup AG* v. *Schweitzer-Mauduit International, Inc.*, Great Britain High Court of Justice, Chancery Division, Patents Court, Claim No. HC 002206, filed Jun. 16, 2011, 4 pages.
Grounds of Invalidity, *Delfortgroup AG* v. *Schweitzer-Mauduit International, Inc.*, Great Britain High Court of Justice, Chancery Division, Patents Court, Claim No. HC 002206, filed Jun. 16, 2011, 4 pages.
Particulars of Claim, *Delfortgroup AG* v. *Schweitzer-Mauduit International, Inc.*, Great Britain High Court of Justice, Chancery Division, Patents Court, Claim No. HC C02206, filed Jun. 16, 2011, 4 pages.
Claim Form, *Delfortgroup AG* v. *Schweitzer-Mauduit International, Inc.*, Great Britain High Court of Justice, Chancery Division, Patents Court, Claim No. HC C02206, filed Jul. 1, 2011, 9 pages.
Opposition of EP 1 482 815 filed by Delfortgroup AG with the European Patent Office on Dec. 3, 2009, 33 pages (filed in German; no English translation available).
"Viscosity conversion tables by Norcross Corporation" einschlie. beta.lich Bezugnahme auf eine Tabelle von Worthington Pump, 1956.
Opposition of EP 1 482 815 filed by Societe Papeterie Leman SAS, with the European Patent Office on Dec. 7, 2009, 38 pages (filed in French; no English translation available).
ASTM E 2187-04, Standard Test Method for Measuring the Ignition Strength of Cigarettes, 9 pages.
"Reduced fire risk (RFR) cigarette paper designs" Presentation by Schweitzer-Mauduit Internation, Jun. 18, 2002, 26 pages.
Tests de viscosite de materlaux filmogenes, ainsi que la fiche technique respective de cheque materiau teste, 34 pages (no English translation available).
Test de viscosite de l'acide alginique H/FD en function du pH, 5 pages (no English translation available).
Protocole suivi pour les essais en annexes A4 et A5, 4 pages (no English translation available).
Attestation de la societe AMCOR FLEXIBLES, establissement repute dans le domaine de l'impression heliographique et flexographique en date du Sep. 17, 2009, 2 pages (no English translation available).
"The Influence of Paper Additives on Cigarette Sidestream and Mainstream Deliveries", B.A.T. Limited, Jul. 27, 1987, 6 pages.
Brochure "Chimie Du Natrosol", 21 pages (no English translation available).
Response to EPO dated Dec. 27, 2007; Remarks dated Apr. 30, 2004; Affidavit of Thomas A. Kraker dated Apr. 22, 2004 (10 pages).
Opposition of EP 1 482 815 filed by Miguel y Costas & Miguel S.A., with the European Patent Office on Dec. 11, 2009, 30 pages.
"Gum Arabic, an ancient ingredient for the 22.sup.nd Century", (text reproduced from Am. Journal of Clinical Nutrition, 1996, vol. 63, p. 392-398, in www.jumbo.th.com.properties ( (4 pages).
D. Verbeken, S. Dierckx, K. Dewettinck, Exudate gums: occurrence, production, and applications, Appl. Microbial. Biotechnol., (2003) 63, pp. 10, 15-16. (3 pages).
"Acacia Gum > Technological Properties", http//www.cniworld.com/acacia.sub.--gum/techno-properties, web page of Colloides Naturels International, (2 pages).
Abdelatif E. Mahmoud, Viscosity Modification of Gum Arabic as a Means of Enhancing Gum Quality, 2006, www.arcsudan.sd/proceedings/40th/meeting, (4 pages).
Alfred L. Wolff (2003), Sales Specification for Miguel y Costas & Miguel S.A., Version No. 1 dated Nov. 6, 2003, (4 pages).
Miguel y Costas & Miguel S.A. Certification of an analysis of gum Arabic (Oct. 2009), (2 pages).
Products of ISC, "Gum Arabic" from http//www.isc.gumgs.com/Default.htm, (2 pages).
Stig Friber, Kare Larsson, Johan Sjoblom, "Food Emulsions" 2004, p. 495, http//books.google.es, (1 page).
Handbook of Food Science, Technology and Engineering 2006, vol. 3. Page "Plant Exudates as Emulsifying Agents", (2 pages).
Agriproducts Group Limited, Section 4: Gum Acacia Functional Properties, (4 pages).
Further Submissions in Opposition to EP 1 482 815 filed by Miguel y Costas & Miguel S.A. with the European Patent Office on Jan. 12, 2012 (26 pages).
A report prepared by Engineer Salvador Mas Marti related to a visit on May 4, 2011 to the facilities of Miguel y Costas & Miguel S.A. in Barcelona (Original in Spanish) (51 pages).
A report prepared by Engineer Salvador Mas Marti related to a visit on May 4, 2011 to the facilities of Miguel y Costas & Miguel S.A. in Barcelona (English Translation) (34 pages).
Certification of BADACHEM on the ink composition (original in Spanish; tranlation in English) (2 pages).
A report prepared by the Notary Public, Mr. Agusti Estribo related to a visit on May 4, 2011 to the facilities of Miguel y Costas & Miguel S.A. in Barcelona (Original in Spanish) (75 pages).
A report prepared by the Notary Public, Mr. Agusti Estribo related to a visit on May 4, 2011 to the facilities of Miguel y Costas & Miguel S.A. in Barcelona (English Translation) (12 pages).
A report of analysis carried by the Universitat de Bacelona between Jul. 7 and 8, 2011 (Original in Spanish) (6 pages).
A report of analysis carried by the Universitat de Barcelona between Jul. 7 and 8, 2011 (English Translation) (6 pages).
A permeability analysis of the smoking paper carried out at KG ASL—Analytik Service Labor GmbH & Co., Hamburg, Germany (6 pages).
Test Report of ASTM tests of cigarettes, carried out at Laboratoire National de Metrologie et d'Essais (LNE) in France (5 pages).
Report of experiments—ISO12863 tests, carried out by Arista Laboratories, Kingston-Upon-Thames, UK (1 page).
"Product and Technical Information" of Hercules Incorporated, Aqualon Division, Aqualon Ethylcellulose (EC)—Physical and Chemical Properties—2002 (43 pages).
Reply to the Oppositions file against EP 1 482 815 filed by Schweitzer-Mauduit International, Inc. with the European Patent Office on Sep. 27, 2010 (55 pages).
Ignition Proclivity Test Trials (4 pages).
Norman, Alan B. et al., "Measurement of Gas Diffusion Capacity of Cigarette Papers" Beitrage zur Tabakforschung International/Contributions to Tobacco Research, vol. 21, No. 8, Dec. 2005 (10 pages).
Chaplin, Martin, "Water Structure and Science" Aug. 11, 2009, [cited Sep. 22, 2010] http://www.lsbu.ac.uk/water/hyarabic.html (2 pages).
McHugh, Dennis J., "Production and utilization of products from commercial seaweeds . . . "FAO Corporate Document Repository Sep. 24, 2010, Sep. 24, 2010. (37 pages).

* cited by examiner

SMOKING ARTICLES WITH REDUCED IGNITION PROCLIVITY CHARACTERISTICS

RELATED APPLICATIONS

The present application is a Continuation application of U.S. application Ser. No. 10/891,375, filed Jul. 14, 2004, which is a Divisional application of U.S. application Ser. No. 10/055,027, which was filed on Jan. 23, 2002, now U.S. Pat. No. 6,779,530.

BACKGROUND OF THE INVENTION

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they self-extinguish upon being dropped or left in a free burning state on combustible materials.

It has long been recognized in the tobacco industry that the cigarette wrapper has a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate, tends to self-extinguish, and has a higher puff count.

U.S. Pat. No. 5,878,753 to Peterson and U.S. Pat. No. 5,820,998 to Hotaling, et al. which are incorporated herein by reference, for example, describe a smoking article wrapper being treated with a film-forming aqueous solution to reduce permeability. U.S. Pat. No. 5,878,754 to Peterson which is also incorporated herein by reference describes a smoking article wrapper being treated with a non-aqueous solution of a solvent soluble polymer dissolved in a non-aqueous solution to reduce permeability.

Although some improvements have been made in the art, there is still a need for an improved method for producing a cigarette wrapper with reduced ignition proclivity properties. Specifically, a need exists for an improved method of applying a film-forming solution to a paper wrapper in discrete areas for decreasing the permeability of the wrapper down to a desired range, especially when the wrapper has an initially high porosity.

SUMMARY OF THE INVENTION

The present invention is generally directed to paper wrappers for smoking articles with reduced ignition proclivity and to a process for making the wrappers. For example, in one embodiment, the process includes the steps of providing a paper wrapper made from a paper web. For example, the paper wrapper can contain flax fibers, softwood fibers, hardwood fibers and mixtures thereof. The paper wrapper can also include a filler, such as calcium carbonate, in an amount from about 10% to about 40% by weight.

A film-forming composition is applied to the paper wrapper at particular locations. The multiple layers of the film-forming composition form treated discrete areas on the wrapper. The discrete areas are separated by untreated areas. The treated discrete areas have a permeability within a predetermined range sufficient to reduce ignition proclivity. For example, the treated areas can reduce ignition proclivity by reducing oxygen to a smoldering coal of the smoking article as the coal burns and advances into the treated areas.

In accordance with the present invention, the film-forming composition contains a film-forming material. The film-forming material has a relatively low viscosity which typically indicates a lower molecular weight. By using a film-forming material having a relatively low viscosity, the film-forming composition can have a higher solids content and yet have a solution viscosity capable of being used in conventional application techniques, such as being used in a gravure printing process. For example, the film forming material contained within the composition can have a viscosity of less than about 500 cP when present in a 3% aqueous solution at 25° C. More particularly, the film-forming material can have a viscosity of less than about 250 cP at the above conditions, particularly less than about 100 cP at the above conditions, and in one embodiment, at a viscosity of about 20-60 cP at the above conditions.

The solids content of the film-forming composition can be at least 6% by weight, particularly at least 10% by weight, and more particularly in an amount from about 10% to about 20% by weight. The film-forming material can be, for instance, an alginate, such as sodium alginate. It should be understood, however, that various other film-forming materials can be used. Other film-forming materials that are believed to be useful in the present invention include guar gum, pectin, polyvinyl alcohol, cellulose derivatives such as ethyl cellulose, methyl cellulose, carboxymethyl cellulose, starch, and starch derivatives.

The viscosity of the film-forming composition can vary depending upon the manner in which the composition is applied to the paper wrapper. For most applications, however, the viscosity of the film-forming composition should be at least 250 cP, particularly at least 500 cP, more particularly at least 800 cP, and in one embodiment at a viscosity of at least 1000 cP or greater at 25° C. The composition can have a pH of below about 8.0, such as below about 7.5. For example, the pH of the composition can be from about 4 to about 7.5. In one embodiment, the film-forming composition can be heated in order to lower the viscosity of the composition as it is being applied to the paper wrapper.

The film-forming composition can be can be applied to the paper wrapper according to various methods. For example, the composition can be printed onto the paper using, for instance, flexography, direct gravure printing, and offset gravure printing.

In one embodiment, the discrete areas formed by the film-forming composition are in the shape of circumferential bands disposed longitudinally along the smoking article. The bands can have a width of greater than about 3 mm, such as from about 4 mm to about 10 mm. The bands can be spaced from each other at a distance of from about 5 mm to about 50 mm and particularly from about 10 mm to about 40 mm.

The amount of the film-forming composition that is applied to the paper wrapper depends upon the particular application and various factors. For example, the film-forming composition can be applied to the wrapper in an amount from about 1% to about 30% by weight based upon the weight of the wrapper within the treated areas, and particularly in an amount from about 2% to about 20% by weight.

Once applied to the paper wrapper, the treated areas can have a permeability of less than about 40 Coresta, particularly less than about 30 Coresta, and more particularly from about 5 Coresta to about 25 Coresta. The initial permeability of the paper wrapper can be from about 20 Coresta to about 90 Coresta or greater.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
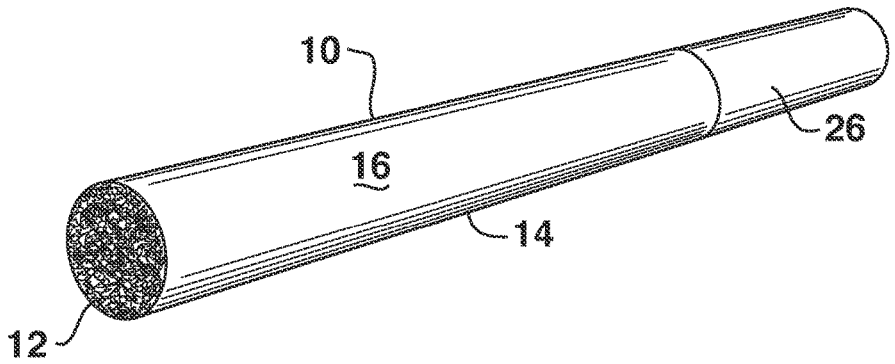
FIG. 1 is a perspective view of a smoking article made in accordance with the present invention.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The invention relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test". In the Cigarette Extinction Test, a lit cigarette is placed on one or more layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In general, smoking articles having reduced ignition proclivity are made according to the present invention by applying in discrete areas to a wrapping paper a film-forming composition. The film-forming composition contains a film-forming material. In accordance with the present invention, a relatively low viscosity film-forming material is used which allows the composition to contain a higher solids content and yet still be applied to the paper wrapper through conventional techniques, such as printing. By using a lower viscosity material at higher solid levels, the present inventors have discovered that more continuous films are formed that do not contain cracks or other imperfections. Ultimately, it has been discovered that film-forming compositions made in accordance with the present invention are better suited to reducing the permeability of paper wrappers than many conventional formulations.

It is believed that the general principles of the present invention can be used in conjunction with any suitable film-forming material in producing a film-forming composition. For example, film-forming materials that can be used in accordance with the present invention include alginates, guar gum, pectin, polyvinyl alcohol, cellulose derivatives such as ethyl cellulose, methyl cellulose, and carboxymethyl cellulose, starch, starch derivatives, and the like.

The process and products made according to the present invention will now be described in greater detail with particular reference to the use of a film-forming composition containing an alginate. It should be understood, however, that the discussion surrounding the use of an alginate is for exemplary purposes only and that it is believed that many other different types of film-forming materials may be incorporated into the process.

In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In the past, alginates have been used to form low permeability areas on cigarette wrapping papers in order to decrease the ignition proclivity characteristics of a smoking article incorporating the wrapper. The alginate solutions used to form the treated areas, however, generally contained a relatively low solids level of the alginate. As described above, however, the present invention is directed to using generally lower viscosity alginates at higher solids levels.

For example, alginates that may be used according to the present invention have a viscosity of less than about 500 cP when contained in a 3% by weight aqueous solution at 25° C. More particularly, alginates that can be used according to the present invention have a viscosity of less than 250 cP at the above conditions, particularly less than 100 cP, and in one embodiment at a viscosity of about 20-60 cP. As used herein, viscosity is determined by a Brookfield LVF Viscometer. Commercially available alginates that may be used in accordance with the present invention include KELGIN RL, MANUCOL LD AND MANUCOL LB, which are all commercially available from the ISP Corporation.

At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the paper. For instance, the solution viscosity of the composition can be adjusted depending upon whether or not the composition is being sprayed onto the paper or printed onto the paper.

In general, alginate compositions made in accordance with the present invention can contain alginate and water. Although not necessary, other ingredients may also be included in the composition. For instance, in one embodiment, a filler can be contained within the composition. The filler can be, for instance, calcium carbonate, calcium chloride, calcium lactate, calcium gluconate, and the like. In addition to calcium compounds, other metal compounds can also be included, including similar magnesium compounds. In one embodiment, the metal cation present in the filler can partially cross-link with the alginate.

Once the alginate composition or other film-forming composition is formulated, the composition is applied to a paper wrapper in discrete areas. The manner in which the composition is applied to the paper wrapper can vary. For example, the composition can be sprayed, brushed or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

The amount of the composition that is applied to the wrapping paper during each successive application of the composition can also vary. For instance, in some applications, the composition is first applied to the wrapping paper at relatively high amounts. In successive steps, the amount of the composition applied to the paper is decreased. In other applications, however, the composition is first lightly applied to the wrapping paper. After initial application, heavier amounts of the composition are then applied to the paper. By varying the amount applied to the wrapping paper during each step, areas having reduced ignition proclivity can be formed on the wrapper with controlled properties.

Film-forming compositions having a relatively high solids content made in accordance with the present invention have been found well suited to forming reduced ignition proclivity areas on cigarette wrapping papers. Whether used in a single pass operation or in a multi-pass operation, it has been found that the compositions are very effective in reducing the permeability of the paper wrapper in the treated areas and in reducing the ability of a smoking article incorporating the wrapper to ignite adjacent surfaces. Of particular advantage, film-forming compositions made in accordance with the present invention are well suited to shutting down the permeability and the ignition proclivity characteristics of a paper wrapper having a relatively high initial permeability, such as a paper wrapper having a permeability of at least 60 Coresta units.

Figure 2:
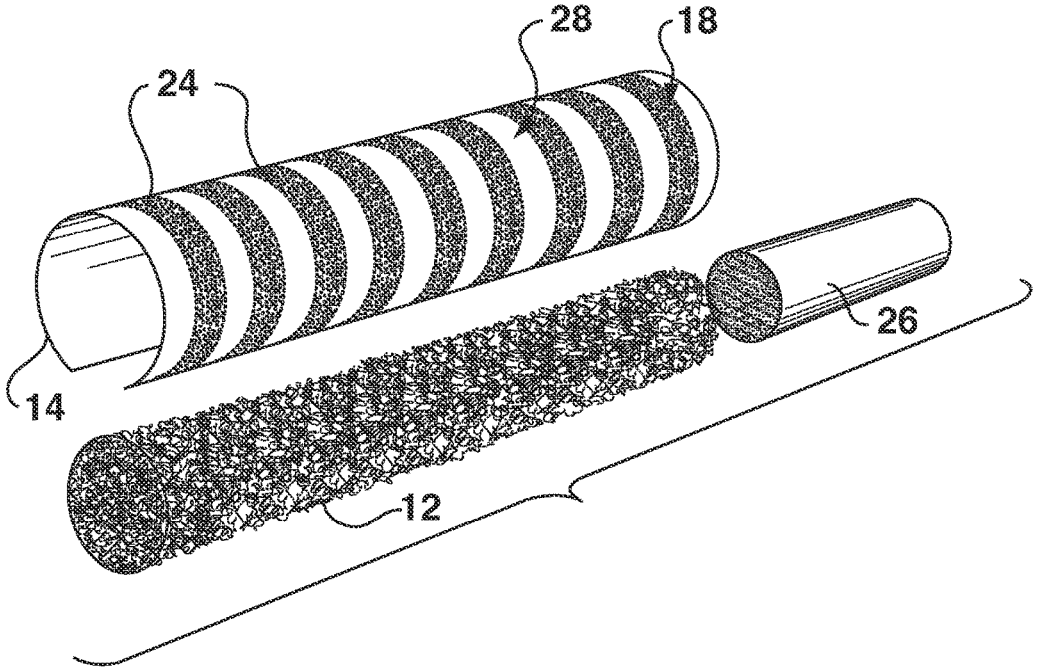
FIG. 2 is an exploded view of the smoking article illustrated in FIG. 1.

In order to assist in describing and explaining the present invention, one embodiment of the invention is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper.

Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

For most applications, the paper wrapper will contain a filler. The filler can be, for instance, calcium carbonate, magnesium oxide, or any other suitable material. The total filler loading added to the paper wrapper can be between about 10% to about 40% by weight.

The permeability of a paper wrapper for smoking articles made according to the present invention can generally be from about 10 Coresta units to about 200 Coresta units. In some applications, the permeability can be between about 15 Coresta units to about 55 Coresta units. In one embodiment of the present invention, however, the initial permeability of the paper wrapper is relatively high. For instance, in one embodiment, the permeability of the paper wrapper can be from about 60 Coresta units to about 110 Coresta units, and particularly from about 60 Coresta units to about 90 Coresta units.

The basis weight of cigarette wrapping paper is usually between about 18 gsm to about 60 gsm, and more particularly between about 15 gsm to about 40 gsm. Wrapping papers according to the present invention can be made within any of these ranges.

The wrapping paper may also be treated with a burn control additive, which may also serve as an ash conditioner. Such burn control additives can include, for instance, alkali metal salts, acetates, phosphate salts or mixtures thereof. A particularly preferred burn control additive is a mixture of potassium citrate and sodium citrate. The burn control additive can be added to the paper in an amount from about 0.3% to about 5% by weight, and more particularly from about 0.3% to about 2.5% by weight.

Paper web 14 defines an outer circumferential surface 16 when wrapped around tobacco column 12. Discrete areas 18 of outer circumferential surface 16 are treated with a film-forming composition made in accordance with the present invention, such as an alginate composition. It should also be understood that treated areas 18 could also be disposed on the inner surface of wrapper 14. In other words, wrapper 14 could be rolled around tobacco column 12 so that treated areas 18 are adjacent to the tobacco.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas are essentially invisible in the formed cigarette as shown in FIG. 1. In other words, a smoker may not discern from any outward sign that the wrapper 14 has been treated in discrete areas 18. In this regard, treated areas 18 have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 4 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 5 and 50 mm is appropriate and particularly between about 10 mm and 40 mm. However, it should be understood that the band spacing can be any suitable width as determined by any number of variables. For most applications, the smoking article can contain from 1 to about 3 bands using the above spacing.

Treated areas 18 have a permeability within a range which is known to provide improved ignition proclivity characteristics for the make-up of cigarette 10. As the coal of cigarette 10 burns into treated areas 18, oxygen available to the burning coal is substantially reduced due to the decreased permeability of wrapper 14 in the treated areas. The reduction of oxygen preferably causes the cigarette to self-extinguish in the treated areas 18 when in contact with a substrate. Applicants have determined that a preferred permeability is less than 40 ml/min/cm$^2$ (CORESTA), particularly less than 30 ml/min/cm$^2$, and generally within a range of 5 to 25 ml/min/cm$^2$. Applicants have found that this range provides the desired self-extinguishing results as the cigarette coal burns into the treated areas.

Besides permeability, another measurement that can be used to indicate reduced ignition proclivity properties is Burn Mode Index. In fact, the Burn Mode Index of a paper wrapper can be more accurate in indicating the burning characteristics of a paper as opposed to simply measuring the permeability of the paper. The test for determining Burn Mode Index is explained in U.S. Pat. No. 4,739,775 to Hampl, which is incorporated herein by reference.

In order to exhibit reduced ignition proclivity properties, the Burn Mode Index ("BMI") of the treated areas 18 can be generally less than about 8 cm$^{-1}$, and particularly from about 1 cm$^{-1}$ to about 5 cm$^{-1}$. For instance, in one embodiment, the burn mode index of the treated areas 18 can be from about 1 cm$^{-1}$ to about 3 cm$^{-1}$.

The composition applied to wrapper 14 in treated areas 18 provides the reduced permeability in the treated areas.

The amount of composition that is added to the paper will depend upon various factors, including the type of composition that is used and the desired result. For most applications, the film-forming composition, can be added to the paper in an amount from about 1% to about 30% by weight of the paper within the banded region, and particularly from about 2% to about 20% by weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 15% by weight. For wrapping papers having a permeability greater than about 60 Coresta units, on the other hand, the composition can be applied to the paper in an amount from about 8% to about 30% by weight.

The present invention pertains to a smoking article wrapper for use with smoking articles, as essentially described above, as well as a method for making the smoking article wrapper.

Figure 3:
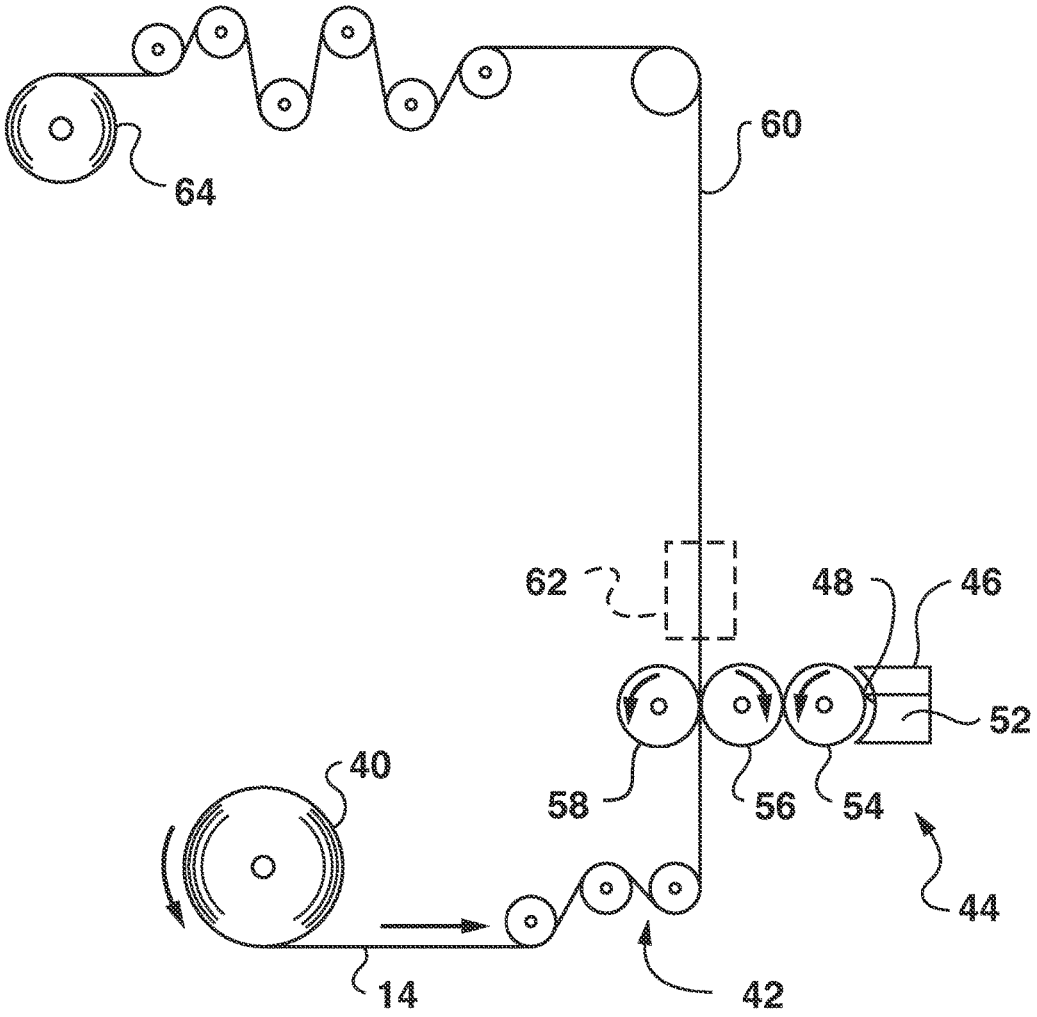
FIG. 3 is a system for treating a paper wrapper in accordance with the present invention.

As described above, the composition can be sprayed, brushed, or printed onto the wrapper. In general, any suitable printing process can be used in the present invention. Applicants have found that suitable printing techniques include gravure printing, or flexographic printing. In one embodiment, as illustrated in FIG. 3, a paper layer 14 is unwound from a supply roll 40 and travels in the direction indicated by the arrow associated therewith. Alternatively, the paper layer 14 may be formed by one or more papermaking processes and passed directly into the process 50 without first being stored on a supply roll 40.

As shown in FIG. 3, the paper layer 14 passes through the nip of an S-roll arrangement 42 in a reverse-S path. From the S-roll arrangement 42, the paper layer 14 passes to a gravure printing arrangement 44. The gravure printing process may be a direct print process or an indirect print process, such as by using an offset printer. FIG. 3 depicts an indirect print process.

The gravure printing arrangement contains a composition tank 46 and a doctor blade 48 which is used to apply a composition 52 to a gravure roll 54.

The gravure roll 54 may be engraved with a conventional continuous cell pattern (e.g., quadrangular cell pattern) arranged in parallel bands across the width of the roll with nonengraved areas between each band. Each gravure cell holds a small amount of the composition which is released in a pattern onto a rubber applicator roll 56. The paper layer 14 passes through a nip between the rubber applicator roll 56 and a cooperating backup roll 58. The composition is transferred from the applicator roll 56 to the surface of the paper layer 14 thereby forming a coated paper 60. The speeds of the gravure roll 54 and the applicator roll 58 may be controlled so they are the same or so they differ by a minor amount to influence the application of the composition. Once the composition is applied to the paper layer 14, the paper layer can be dried if desired.

For instance, as shown in FIG. 3, after leaving the gravure printing arrangement 44, the paper web 14 is passed through a drying operation 62. During the drying operation 62, the treated paper can be dried using various devices and methods. For example, in one embodiment, the drying operation 62 includes a drying device that passes hot gas such as air over the paper web. The temperature of the air can range from about 100° F. to about 600° F. In an alternative embodiment, the drying device can be a steam can. After being treated with a composition by the gravure printing device, the paper web can be placed in contact with the steam can for drying the composition.

Besides drying the paper with a hot gas stream or with a steam can, in another embodiment of the present invention the paper can be dried by contacting the paper with infra-red rays. For example, in one embodiment, the paper can be passed under a infra-red heating lamp.

In still another alternative embodiment of the present invention, the paper web 14 can be simply air dried during the drying operation 62.

It should be understood that the process illustrated in FIG. 3 represents merely one embodiment for applying a composition to the paper wrapper. For instance, a greater amount of printing stations may be included at any location for applying the composition in a multi-pass process.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed is:

1. A process for producing a paper wrapper having reduced ignition proclivity characteristics when incorporated into a smoking article comprising:

applying a film-forming composition to a paper wrapper at particular locations, the film-forming composition including a film-forming material comprising at least one of alginate, guar gum, pectin, polyvinyl alcohol, a cellulose derivative, starch, a starch derivative, or mixtures thereof, the film-forming material having a molecular weight such that the film-forming material has a viscosity of less than about 500 cP when present in a 3% by weight aqueous solution at 25° C., the film-forming composition forming treated discrete areas on the paper wrapper, the treated discrete areas being separated by untreated areas, the treated discrete areas having a BMI of less than 5 $cm^{-1}$, the treated areas having a permeability of less than about 40 Coresta, the untreated areas of the paper wrapper having a permeability of about 55 Coresta to about 110 Coresta.

2. The process of claim 1, wherein the film-forming material is present in the composition such that the film-forming composition has a solids content of at least 6% by weight.

3. The process of claim 1, wherein the film-forming material has a viscosity of less than about 250 cP when present in a 3% by weight solution at 25° C.

4. The process of claim 1, wherein the alginate comprises a sodium alginate.

5. The process of claim 1, wherein the treated areas have a BMI of from about 1 $cm^{-1}$ to about 5 $cm^{-1}$.

6. The process of claim 1, wherein the film-forming composition is printed onto the paper wrapper.

7. The process of claim 6, wherein the film-forming composition is printed onto the paper wrapper in a multi-pass operation.

8. The process of claim 1, wherein the treated areas comprise a plurality of discrete circumferential bands disposed longitudinally along the paper wrapper, the bands having a width of greater than 4 mm, the bands being spaced from each other from a distance of from about 10 mm to about 40 mm.

9. The process of claim 1, wherein the film-forming composition is applied to the paper wrapper using gravure printing.

10. The process of claim 1, wherein the film-forming composition is applied to the paper wrapper in the treated discrete areas in an amount up to about 30% by weight based upon a basis weight of the paper wrapper.

11. A process as defined in claim 1, further comprising the step of drying the paper wrapper after the film-forming composition has been applied.

12. A process as defined in claim 1, further comprising the step of incorporating the paper wrapper into a smoking article, the smoking article comprising a column of a smokable tobacco, the column of the smokable tobacco being surrounded by the paper wrapper.

13. A process as defined in claim 1, wherein the film-forming composition comprises an aqueous composition.

* * * * *